US006415860B1

(12) United States Patent
Kelly et al.

(10) Patent No.: US 6,415,860 B1
(45) Date of Patent: Jul. 9, 2002

(54) CROSSFLOW MICRO HEAT EXCHANGER

(75) Inventors: Kevin W. Kelly; Chad R. Harris; Mircea S. Despa, all of Baton Rouge, LA (US)

(73) Assignee: Board of Supervisors of Louisiana State University and Agricultural and Mechanical College, Baton Rouge, LA (US)

( * ) Notice: Subject to any disclaimer, the term of this patent is extended or adjusted under 35 U.S.C. 154(b) by 0 days.

(21) Appl. No.: 09/501,215

(22) Filed: Feb. 9, 2000

(51) Int. Cl.[7] ..... F28D 1/03

(52) U.S. Cl. ..... 165/748; 165/164; 165/DIG. 395; 165/166

(58) Field of Search ..... 165/164–167, 165/148, 151, 181

(56) References Cited

U.S. PATENT DOCUMENTS

| | | | | | |
|---|---|---|---|---|---|
| 1,860,125 | A | * | 5/1932 | Bassler | 165/165 |
| 3,635,284 | A | * | 1/1972 | Hoch | 165/39 |
| 4,516,632 | A | * | 5/1985 | Swift et al. | 165/167 |
| 5,016,707 | A | * | 5/1991 | Nguyen | 165/167 |
| 5,681,661 | A | | 10/1997 | Kelly | 428/601 |
| 5,811,062 | A | * | 9/1998 | Wegeng et al. | 422/129 |
| 6,129,973 | A | * | 10/2000 | Martin et al. | 428/166 |

FOREIGN PATENT DOCUMENTS

| | | | | |
|---|---|---|---|---|
| DE | 875280 B1 | * | 4/1953 | 165/165 |
| WO | WO 97/29223 | | 8/1997 | |

OTHER PUBLICATIONS

Lattice–Boltzmann Simulation Code Development for Micro–Fluidic Systems, Rector et al., Presented at Spring 1998 AIChE meeting (New Orleans), available at: http://www.pnl.gov/microcats/aboutus/publications/microsystemws/aiche.pdf.*

Bacher, W., "The LIGA technique and its potential for microsystems—a survey," *IEEE Trans. Indust. Electr.*, vol. 42, pp. 431–441 (1995).

Bier, W. et al., "Gas to gas heat transfer in micro heat exchangers," *Chemical Engineering and Processing*, vol. 32, pp. 33–43 (1993).

Rachkovskij, D.A. et al., "Heat exchange in short microtubes and micro heat exchangers with low hydraulic losses," *Microsystem Technologies*, vol. 4 pp. 151–158 (1998).

(List continued on next page.)

*Primary Examiner*—Allen Flanigan
(74) *Attorney, Agent, or Firm*—André J. Porter; Bonnie J. Davis; John H. Runnels

(57) ABSTRACT

An extremely high efficiency, crossflow, fluid-fluid, micro heat exchanger is disclosed. To concurrently achieve the goals of high mass flow rate, low pressure drop, and high heat transfer rates, the heat exchanger comprises numerous parallel, but relatively short microchannels. The performance of these heat exchangers is superior to the performance of previously available heat exchangers. Typical channel heights are from a few hundred micrometers to about 2000 micrometers, and typical channel widths are from around 50 micrometers to a few hundred micrometers. The micro heat exchangers offer substantial advantages over conventional, larger heat exchangers in performance, weight, size, and cost. The heat exchangers are especially useful for enhancing gas-side heat exchange. Some of the many possible applications include aircraft heat exchange, air conditioning, portable cooling systems, and micro combustion chambers for fuel cells. The use of microchannels in a cross-flow micro-heat exchanger decreases the thermal diffusion lengths substantially, allowing substantially greater heat transfer per unit volume or per unit mass than has been achieved with prior heat exchangers. The cross-flow micro-heat exchanger have performance characteristics that are superior to state-of-the-art designs, as measured on a per-unit-volume or per-unit-mass basis.

15 Claims, 9 Drawing Sheets

OTHER PUBLICATIONS

Becker, E. et al., "Production of separation–nozzle systems for uranium enrichment by a combination of x–ray lithography and galvanoplastics," *Naturwissenschaften*, vol. 69, pp. 520–523 (1982).

Brown, R., "LSU gets $1.3M for heat exchange research," *LSU Today*, vol. 16, No. 16, p. 4 (Nov. 12, 1999).

Harris, C. et al., "Inexpensive, quickly producible x–ray mask for LIGA," *Microsystems Technologies*, vol. 5, pp. pp. 189–193 (1999).

Internet page "Micro Heat Exchangers," http://www.imm–mainz. de/english/developm/products/exchange-.html (1998).

Kelly, K., "Heat exchanger design specifications," slides presented at DARPA Principal Investigators Meeting, Atlanta, Georgia (Jan. 13, 2000).

Kelly, K., "Applications and Mass Production of High Aspect Ratio Microstructures Progress Report," MEMS Semi–Annual Reports (Jul. 1999).

Kleiner, M. et al., "High performance forced air cooling scheme employing microchannel heat exchangers," *IEEE Trans. Components, Packaging, and Mfg Tech., Part A*, vol. 18, pp. 795–804 (1995).

Maner, A. et al., "Mass production of microdevices with extreme aspect ratios by electroforming," *Plating and Surface Finishing*, pp. 60–65 (Mar. 1988).

Parrino, M. et al., "A high efficiency mechenically assembled aluminum radiator with real flat tubes," SAE Technical Paper Series 940495 (1994).

Tonkovich, A. et al., "The catalytic partial oxidation of methane in a microchannel chemical reactor," Preprints from the *Process Miniaturization: 2nd International Conference on Microreaction Technology*, pp. 45–53 (New Orleans, Mar. 1998).

Tuckerman, D., et al. "High–performance heat sinking for VLSI," *IEEE Electron. Device Letters*, vol. 2, No. 5, pp. 126–129 (May 1981).

Webb, R. et al., "Improved thermal and mechanical design of copper/brass radiators," SAE Technical Paper Series, No. 900724 (1990).

Wegeng, R. et al., "Developing new miniature energy systems," *Mechanical Engineering*, pp. 82–85 (Sep. 1994).

* cited by examiner

CROSSFLOW MICRO HEAT EXCHANGER

The development of this invention was partially funded by the Government under grant number DABT63-95-C-0020 awarded by the Defense Advanced Projects Research Agency. The Government has certain rights in this invention.

This invention pertains to heat exchangers, particularly to very high efficiency crossflow heat exchangers.

Heat exchangers are used in a wide variety of industrial, commercial, aerospace, and residential settings. Just three of many examples are the radiator of an automobile, the condenser of an air conditioner, and numerous aerospace applications. There is a continuing need for heat exchangers having greater efficiency and lower cost.

The function of many types of heat exchangers is to transfer as much heat as possible from one fluid (usually a liquid) to another fluid (usually a gas) in as little space as possible, with as low a pressure drop (pumping loss) as possible. It would be desirable to reduce the size of the heat exchanger needed for a given rate of heat exchange, if there were a practical and feasible way to do so.

As structures shrink, i.e., as their surface area-to-volume ratio increases, thermal coupling between the structure and surrounding medium (gas or liquid) increases. The improved coupling is especially important for heat exchange between solid surfaces and gases, because thermal resistance at the gas-solid interface tends to dominate overall heat transfer.

However, in prior heat exchangers, as the diameter of the fluid channels has decreased, the pressure gradient for a given bulk velocity through those channels has increased dramatically, which has limited the reduction in size that has been possible in prior heat exchangers. Attaining a high heat transfer rate in prior heat exchangers has required that the mass flow rate (or volumetric flow rate) of the gas be high, regardless of the coupling between the gas and the channel walls. In prior micro heat exchangers, the channel length to hydraulic diameter ratio, $L/D_H$, has typically been quite high (similar to the ratios for macroscale heat exchangers), which requires very large pressure drops.

M. Kleiner et al., "High performance forced air cooling scheme employing microchannel heat exchangers," *IEEE Trans. Components, Packaging, and Mfg Tech.*, Part A, vol. 18, pp. 795–804 (1995) discloses a heat exchanger using tubes to duct air to a heat sink containing microchannels that appeared to have relatively high $L/D_H$ ratios. In one example, an optimum channel width was said to be 482 $\mu$m for a channel length of 5 cm, or an $L/D_H$ ratio of ~50. See also FIG. 1 of the Kleiner et al. paper.

A. Tonkovich et al., "The catalytic partial oxidation of methane in a microchannel chemical reactor," Preprints from the *Process Miniaturization: 2nd International Conference on Microreaction Technology*, pp. 45–53 (New Orleans, March 1998) discloses a microchannel reactor formed of stacked planar sheets, used for non-equilibrium methane partial oxidation. The channels were described as having heights and widths between 100 $\mu$m and 1000 $\mu$m, and lengths of a few centimeters.

U.S. Pat. No. 4,516,632 discloses a microchannel crossflow fluid heat exchanger formed by stacking and bonding thin metal sheets (slotted and unslotted) on top of one another. Successive slotted sheets are rotated 90 degrees with respect to one another to form a crossflow configuration. The heat exchanger was said to be suitable for use in a Stirling engine having a liquid as the working fluid. The heat exchanger was required to be capable of accommodating liquids at variable pressures as high as several thousand pounds per square inch. As depicted, the channels appear to have relatively high $L/D_H$ ratios.

U.S. Pat. No. 5,681,661 discloses a heat sink formed by covering an article of manufacture, which may have macroscopic surfaces, with a plurality of HARMs, namely microposts. See also WO 97/29223. High aspect ratio microstructures (HARMs) are generally considered to be microstructures that are hundreds of micrometers in height, with widths usually measured in tens of micrometers, although the dimensions of particular HARMS may be greater or smaller than these typical measurements. HARMs may be made of polymers, ceramics, or metals using, for example, the three-step LIGA process (a German acronym for lithography, electroforming, and molding). There is no disclosure of any fluid-to-fluid heat exchanger.

D. Tuckerman, et al. "High-performance heat sinking for VLSI," *IEEE Electron. Device Letters*, Vol. 2, No. 5, pp. 126–129 (May 1981) discloses the removal of heat from a silicon substrate using a water-cooled, microchannel heat sink at a pressure drop up to 31 psi.

R. Wegeng et al., "Developing new miniature energy systems," *Mechanical Engineering*, pp. 82–85 (Sept. 1994) discloses a two-phase, vapor-compression refrigeration cycle, micro heat pump comprising compressors, condensers, and evaporators. The condensers and evaporators incorporated microchannels having cross-sectional dimensions on the order of 50 to 1000 microns. Using the refrigerant R-124 in such a heat pump, it was reported that in proof-of-principle tests an overall heating rate of 6 to 8 watts was achieved with an R- 124 flow of about 0.2 gram per second, a temperature difference of 13° C., and a pressure drop of 1 psi.

The Internet page "Micro Heat Exchangers" (1998) depicts a miniaturized plate heat exchanger consisting of several layers of microstructured plates, intended for the countercurrent flow of fluids (presumably, liquids) in the different layers. In compliance with M.P.E.P. § 608.01, the citation for the hyperlink to this Internet page has been deleted from the specification, but the citation should appear on the first page of the issued patent under the heading "Other Publications." In addition, a printed copy of this reference is located in the file history of this patent.

Car radiators have a cross flow design that typically uses only the air that flows over the radiator's coils by virtue of the pressure drop associated with the motion of the automobile. A commonly used measure of performance for a car radiator is the ratio of heat transfer: frontal area, divided by the difference between the inlet temperatures of the coolant (usually a water-ethylene glycol mixture) and of the air. For state-of-the-art innovative car radiators, this figure is typically about 0.31 W/K-cm$^2$. However, these automobile radiators are quite thick (~2.5 cm or more). See, e.g., R. Webb et al., "Improved thermal and mechanical design of copper/brass radiators," SAE Technical Paper Series, No. 900724 (1990); and M. Parrino, et al., "A high efficiency mechanically assembled aluminum radiator with real flat tubes," SAE Technical Paper Series, No. 940495 (1994).

We have discovered an extremely high efficiency, crossflow, fluid-fluid, micro heat exchanger formed from high aspect ratio microstructures. To concurrently achieve the goals of high mass flow rate, low pressure drop, and high heat transfer rates, the novel heat exchanger comprises numerous parallel, but relatively short microchannels. The performance of these heat exchangers is superior to the performance of previously available heat exchangers, as measured by the heat exchange rate per unit volume or per unit mass. Typical gas channel lengths in the novel heat exchangers are from a few hundred micrometers to about 2000 micrometers, with typical channel widths from around 50 micrometers to a few hundred micrometers, although the dimensions in particular applications could be greater or smaller. The novel micro heat exchangers offer substantial advantages over conventional, larger heat exchangers in performance, weight, size, and cost.

The novel heat exchangers are especially useful for enhancing gas-side heat exchange. Some of the many possible applications for the new heat exchangers include aircraft heat exchange, air conditioning, portable cooling systems, and micro combustion chambers for fuel cells.

The use of microchannels in a cross-flow micro-heat exchanger decreases the thermal diffusion lengths substantially, allowing substantially greater heat transfer per unit volume or per unit mass than has been achieved with prior heat exchangers. The novel cross-flow micro-heat exchanger has performance characteristics that are superior to state-of-the-art innovative car radiator designs, as measured on a per-unit-volume or per-unit-mass basis, using pressure drops for both the air and the coolant that are comparable to those for reported innovative car radiator designs.

The crossflow of the two fluids is advantageous since the temperature of coolant approaches equilibrium over the distance of just a few channel diameters. In most prior micro heat exchanger designs, the fluids have flowed in the plane of the heat exchanger, through relatively long channels, which requires a substantially greater pressure drop than is required by the present invention. As the hydraulic diameter of a fluid channel decreases at a constant fluid velocity, the convection heat transfer coefficient increases, as does the surface area-to-volume ratio. For the fluid temperature to change by a given amount in otherwise identical systems, the required $L/D_H$ ratio decreases as the hydraulic diameter decreases. After the fluid approaches thermal equilibrium with the channel wall (which occurs over the distance of a few $D_H$), no significant additional heat transfer occurs—thereafter a longer L produces a greater pressure drop but is of little benefit to heat transfer.

The invention allows the inexpensive manufacture of high-efficiency heat exchangers capable of supporting high heat fluxes, and high ratios of heat transfer per unit volume (or per unit mass), with minimal entropy production (i.e., a minimal combination of pressure drop and temperature difference between the two fluids exchanging heat). Thermal resistance at the gas/heat exchanger surface boundary is dramatically reduced compared with prior designs.

The dimension of the heat exchanger across which the first fluid flows is less than about 6 mm, preferably less than about 2 mm, most preferably less than about 1 mm. By contrast, it is believed that no prior gas-fluid cross-flow heat exchangers have been thinner than about 2 cm in the direction of the first fluid flow.

The dimension of the coolant fluid channel, measured perpendicular to the direction of the coolant fluid flow and measured perpendicular to the direction of the first fluid flow, is less than about 2 mm, preferably less than about 500 $\mu$m.

The density of the gas channels is at least about 50 per square centimeter, preferably at least about 200 per square centimeter, and in some cases as much as about 1000 per square centimeter or even greater.

Figure 1:
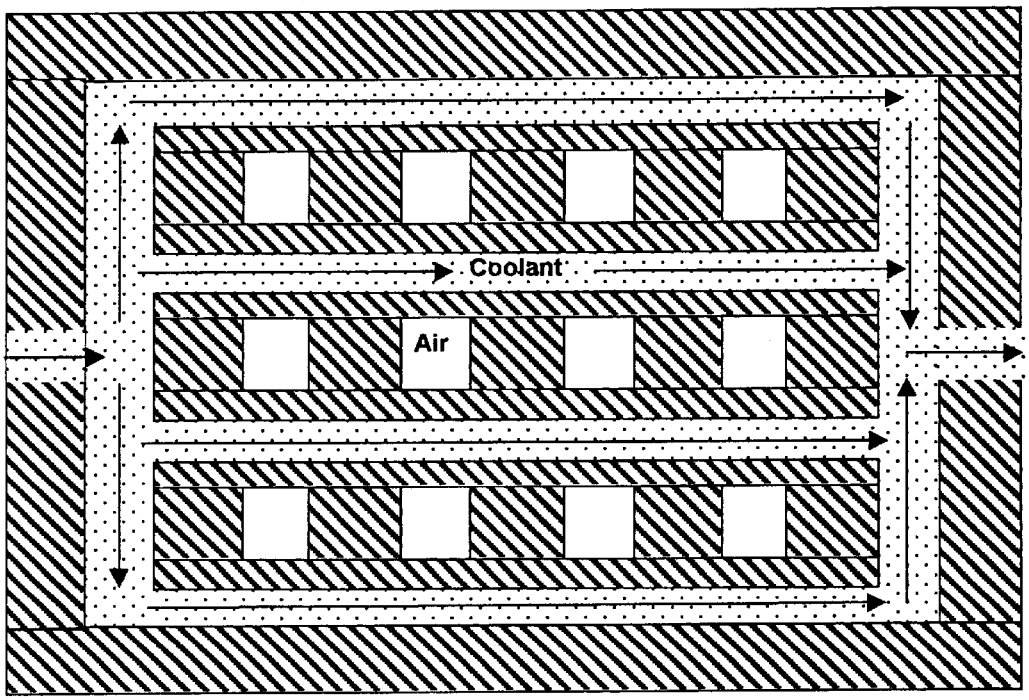
FIG. 1 illustrates schematically a cross section of an embodiment of a cross flow micro heat exchanger in accordance with the present invention.

A schematic illustration of a cross section of an embodiment of a cross flow micro heat exchanger in accordance with the present invention is shown in FIG. 1 (not drawn to scale).

In FIG. 1, the cross-hatched regions denote solid structures through which fluid may not flow, the dotted regions denote channels through which the coolant fluid may flow in the plane of the figure, and the open squares denote cross-sections of the channels through which air, gas, or other fluid may flow perpendicular to the plane of the figure.

Microchannels typically having a width ranging from about 50 $\mu$m to about 1 mm may be used in this invention. Heat transfer is enhanced by constraining the flow to such narrow channels since convective resistance is reduced. However, steep pressure gradients are associated with flow through microchannels. The ensuing high pressure drops have limited the use of microchannels for heat transfer in the past. The novel cross flow micro heat exchanger reaps the high heat transfer benefits of microchannels, while minimizing the penalty associated with a large pressure gradient. In the novel design, a gas such as air passes perpendicularly across the plane of the heat exchanger via numerous (e.g., thousands or more) parallel, short microchannels. A fluid, usually a liquid such as water or a water: ethylene glycol mixture, flows in the plane of the heat exchanger, in a direction generally perpendicular to the flow of the first fluid, i.e., cross flow. Despite the short length of the channels, heat transfer to the gas is substantial. While the pressure gradient within the microchannels for the gas is steep, the short length of those microchannels allows a high mass flow rate through the heat exchanger with a low overall pressure drop. The novel cross flow microchannel design allows much higher ratios of heat transfer per unit weight, and heat transfer per unit volume of the heat exchanger than has been reported for any previous heat exchanger.

The design of the novel micro heat exchanger is so different from that of previously reported micro heat exchangers that direct comparisons are difficult. Most prior research in the area of micro heat exchangers has focused on cooling electronics, where heat generated by electronic components is removed by a single fluid (typically, air) flowing through channels, fins, or posts located as close as possible to the heat source. By contrast, the novel cross flow heat exchanger addresses a fundamentally different task: namely, to transfer heat from a fluid to a gas, typically from a liquid to a gas. A more pertinent comparison may therefore be to the state of the art in innovative car radiators, which also transfer heat from a fluid to a gas, typically from a water: ethylene glycol mixture to air.

As discussed further below, we have constructed an analytical model that predicts that the novel cross flow micro heat exchangers should perform surprisingly well, even when they are manufactured from polymers, despite the fact that polymers generally have poor thermal conductivity. The thermal resistance of a solid is proportional to the length of the conduction path, which is very short across the micro heat exchanger. Thus even polymeric heat exchangers can perform well. However, even better heat exchange is expected in future embodiments molded instead of ceramic, met al, or ceramic/met al composites, which generally have higher thermal conductivities than those of polymers.

We have designed and fabricated a cross flow micro heat exchanger intended to transfer heat from a water-ethylene glycol mixture to air. We describe below briefly our design calculations for the prototype. The calculated performance of the prototype heat exchanger is compared to the performance of state-of-the-art innovative car radiators on the basis of size, mass, pressure drop, heat transfer: frontal area ratio, heat transfer: mass ratio, and heat transfer volume ratio. The manufacturing process used to construct the prototype, which combines the LIGA micromachining process with more traditional machining and bonding techniques, is also described below.

Performance Parameters

Performance criteria for the prototype were selected in advance. The performance criteria were based in part on performance criteria for current innovative car radiators. The performance criteria would vary slightly for other applications (e.g., air conditioning or aerospace), but in general most of the design principles discussed below may readily be applied in or extended to other applications.

The function of a car radiator is to dissipate heat from a water-ethylene glycol mixture into the air to prevent engine overheating. For a given set of design constraints (i.e., the pressure drop of each fluid, and the difference in inlet temperatures between the two fluids), a well-designed cross-flow radiator provides a high ratio of heat transfer: frontal area of the radiator. Based on our analysis, the heat exchange rate: frontal area ratio for the prototype is expected to be a factor of about 2–4 lower than those of current innovative car radiators—but the heat transfer: unit volume ratio and the heat transfer: unit mass ratio should be about 20–50 times higher than those of existing radiators.

In addition to heat transfer characteristics, additional performance parameters include noise levels and filtering requirements. To date, we have not performed noise calculations; but since velocities and flow rates are similar to those for existing designs, the noise levels should also be similar. Filtering requirements for the cross flow micro heat exchanger will be greater than for existing car radiators. Means known in the art to filter the fluids may be used to inhibit clogging of the heat exchanger.

Prototype Heat Exchanger Design

Pressure Drop of the Fluids

The head produced by typical automobile radiator fans, or the stagnation head associated with an automobile running at 50 mph, both provide a reasonable measure of the expected pressure drop of air across the heat exchanger. Many such fans produce substantial flow rates across a pressure differential of 175 kPa (0.7 inches of water), while the stagnation head for an automobile running at 50 mph is about 335 kPa. The pressure drop of the air across the heat exchanger was therefore specified as the lower of these two values, 175 kPa. The pressure drop of the water should be low, to reduce pumping requirements. A reasonable pressure drop for water, as determined from the literature, was specified as 5 kPa. The pressure drop for the water was less significant in the design process than the pressure drop for the air.

Inlet Temperatures of the Fluids

Typical inlet temperatures for the air and coolant in innovative car radiator designs are 20° C. and 95° C., respectively. These values were used in the prototype design and analysis.

Geometry

A basic schematic of a portion of the prototype is illustrated in FIG. 1. The lateral dimensions of the design $F_W \times F_H$ that were used in the analysis were 7.6 cm×7.6 cm (3×3 inches). These dimensions were determined by the size of the pattern that may readily be exposed in a single step at the micro-manufacturing facilities at Louisiana State University's Center for Advanced Microstructures and Devices. These dimensions could be increased or decreased as desired for particular applications. (For example, the size could be increased by using multiple exposure steps on a single wafer, or by bonding several smaller pieces together to form a larger composite piece).

Figure 2:
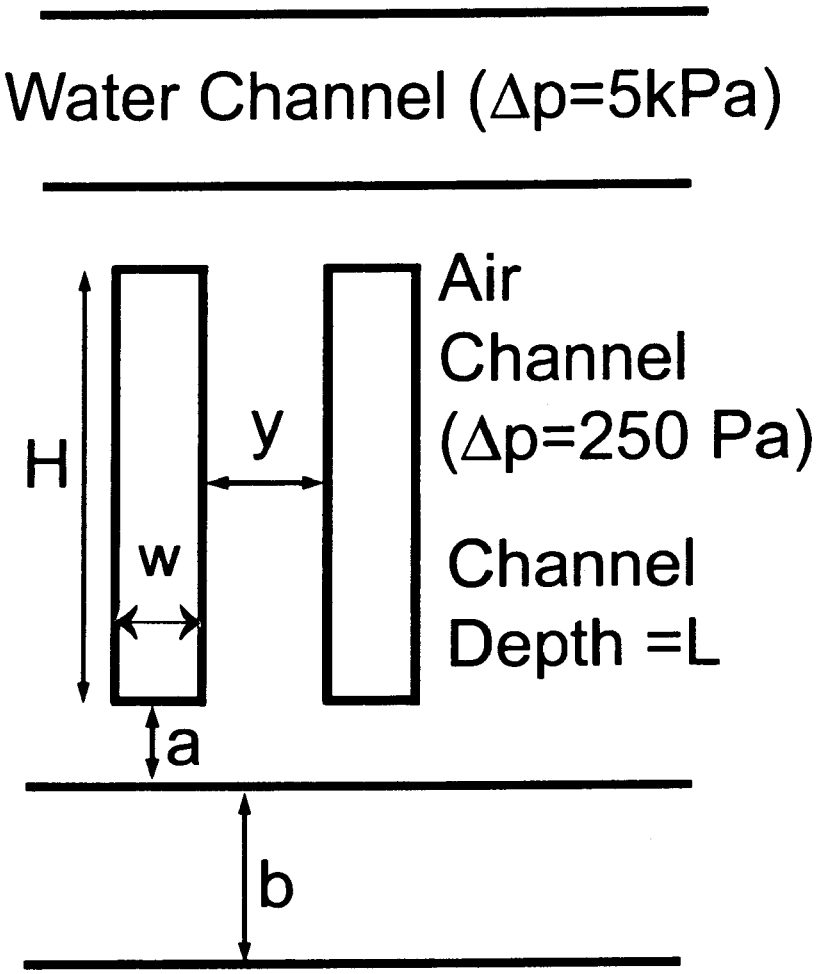
FIG. 2 depicts the dimensions that specify the internal geometry of a prototype heat exchanger.

The dimensions that specified the internal geometry of the heat exchanger for the analysis are illustrated in FIG. 2. Our design analysis treated some of these dimensions as variables, and some as constrained by manufacturing considerations. The dimensions of the cross section of each air channel (w×H) were variable. The width of the fins (y) separating adjacent air channels was also variable. For strength and manufacturing considerations, the minimum allowed value for both the fin width (y) and the channel width (w) was set at 200 $\mu$m. The thickness of the wall (a) separating the water and air was fixed at 100 $\mu$m. This value was chosen primarily because the alignment and bonding of the upper and lower halves of the heat exchanger over dimension (a) was crucial to sealing the coolant channels properly. While a smaller value for (a) would produce an even more efficient heat exchanger, at least in the initial prototype we chose not to have the wall be so thin that potential difficulties in aligning and sealing the coolant channels might arise. To ensure adequate coolant flow area, the minimum allowed width of the coolant channel was 500 $\mu$m. The depth of the coolant channel (not shown in FIG. 2) was approximately 1.2 mm. Finally, the micro-manufacturing capabilities readily available to us limited the thickness of each half of the heat exchanger to 1.0 mm. Since the final manufacturing process for the prototype involved fly-cutting and polishing each half, the maximum length L of the air channels (i.e., the thickness of the heat exchanger) was 1.8 mm.

Design Calculations

Using these constraints, we calculated the geometry that should maximize the heat transfer frontal area ratio for polymer (poly (methyl methacrylate), or PMMA), ceramic, and aluminum heat exchangers.

For example, with a polymer heat exchanger the heat transfer through a single air channel was calculated as follows:

1. For a given value of b, various values of channel width (w) and fin width (y) were selected.

2. While the channel height H was a variable, it is always at least three to four times greater than the width (w). Without specifying H further, the hydraulic diameter, $D_h$, should therefore lie in the range of 1.5 to 2 times the channel width. The value of $D_h$ was initially approximated as 1.75 w.

3. The relation between pressure drop across the air channel and the velocity of air through the channel is given by Equation (1) below, where the first term on the right hand side denotes pressure drop due to viscous drag, and the second term reflects inlet and exit losses. K is a loss coefficient having a value of 1.5. The value of the non-fully developed friction factor, f, was obtained from empirical correlations for non-fully developed flow through air channels. By rearranging Equation (1), the bulk velocity was calculated. (Note: a list of symbols appears at the end of the specification.)

$$\Delta p = \frac{f\rho V^2 L}{2D_h} + K\frac{\rho V^2}{2} \tag{1}$$

4. The average non-fully developed Nusselt number in the air channels is a function of the dimensionless quantities in Equation (2), and is obtained from empirical correlations. See S. Kakac et al., *Handbook of Single Phase Convective Heat Transfer* (1987).

$$Nu = f\left(\frac{L}{D_h RePr}, \frac{w}{H}\right) \tag{2}$$

5. The height of the channel, H, is an important design consideration. For the polymer heat exchanger, we set the height of the fin to be long enough to remove 98% of the heat that would be removed if the fin were infinitely long. This condition is equivalent to finding the value of H that satisfies Equation (3) below. (F. Incropera et al., *Introduction to Heat Transfer* (3rd Ed., 1996))

$$0.98 = \tanh\left(\sqrt{\frac{2h}{yk_{polymer}}}\frac{H}{2}\right) \tag{3}$$

An iterative procedure was used to obtain consistent values of H and $D_1$.

6. The flow within the coolant channels was assumed to be fully developed and laminar. As a first approximation, the inlet and exit temperatures of the coolant within the channel were assumed to be equal. The convection coefficient governing thermal resistance between the coolant and the wall is given by Equation (4) below, in which the hydraulic diameter of the water channel, $D_{h\text{-}cool}$, is a function of b and the width (=1.2 mm).

$$h_{cool} = \frac{4.0k_{cool}}{D_{h-cool}} \tag{4}$$

Figure 3:
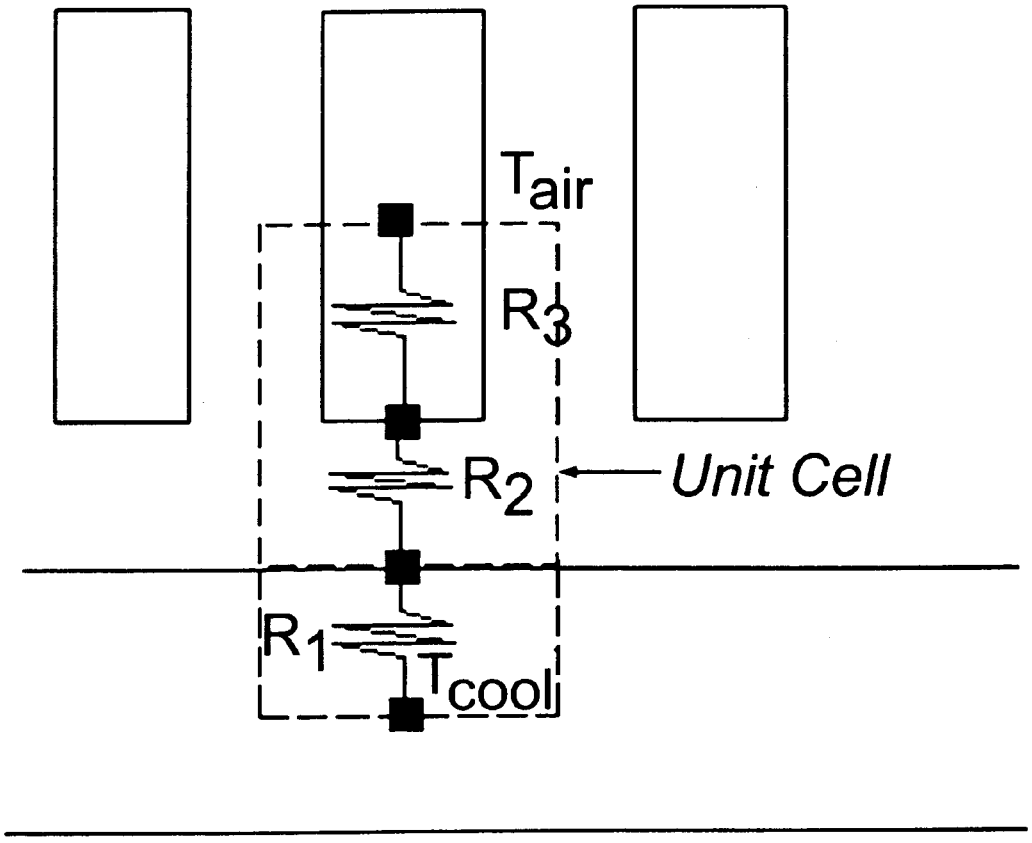
FIG. 3 illustrates schematically the resistive network between one coolant channel and an air channel.

7. The heat transfer to each channel was then calculated. FIG. 3 illustrates schematically the resistive network between one coolant channel and an air channel. The dashed line is the boundary of the unit cell being analyzed. By symmetry, for a sufficiently large array the total heat transfer to one air channel is twice the heat transfer from one coolant channel to one air channel. $R_1$ is the convective resistance at the coolant/wall interface. $R_2$ is the conductive resistance through the thickness of the wall separating the water and air channels. (The assumption of one-dimensional heat transfer in this wall was verified by two-dimensional analysis.) $R_3$ is the effective convective resistance, based on inner area of the air channel and the difference in temperature between the base of the fin and the local temperature of the air. The values of $R_1$, $R_2$, and $R_3$ are given by Equations (4*a*), (4*b*), and (4*c*) below.

$$R_1 = \frac{1}{h_{cool}(w+y)L} \tag{4a}$$

$$R_2 = \frac{a}{k_{wall}(w+y)L} \tag{4b}$$

$$R_3 = \frac{1}{h_{air}(\eta_f H + w)L} \tag{4c}$$

where $\eta_f$, the fin efficiency, is defined by Equation (5) below:

$$\eta_f = \frac{\tanh\left(\sqrt{\frac{2h}{yk_{polymer}}}\frac{H}{2}\right)}{\sqrt{\frac{2h}{yk_{polymer}}}\frac{H}{2}} \tag{5}$$

The sum of $R_1$, $R_2$ and $R_3$ equals the resistance from one coolant channel to an air channel. The total resistance to heat transfer between the coolant and a single air channel, $R_{tot}$, is one half this sum (Equation (6)).

$$R_{tot} = \frac{R_1 + R_2 + R_3}{2} \tag{6}$$

Assuming that the coolant temperature does not vary appreciably across the thickness of the heat exchanger, the exit temperature of the air may be found from Equation (7):

$$\frac{T_{cool} - T_{air-exit}}{T_{cool} - T_{air-inlet}} = \exp\left(-\frac{1}{\dot{m}_{air}c_{p-air}R_{tot}}\right) \tag{7}$$

where the mass flow rate of the air through the channel is $VwHp_{air}$.

Finally, the heat transfer to the air through a single channel is given by Equation (8).

$$q_{channel} = \dot{m}_{air}c_{p-air}(T_{air-exit} - T_{air-inlet}) \tag{8}$$

The area of the unit cell occupying a single channel has dimensions (b+2a+H)(y+w). A good estimate of the total number of air channels (N) in the heat exchanger is obtained by dividing the total area of the heat exchanger ($F_W \times F_H$) by the unit cell area. The total heat transfer for the entire heat exchanger is then given by Equation (9).

$$q = Nq_{channel} \tag{9}$$

8. The initial assumption that the exit temperature and inlet temperature of the coolant are equal provides a slightly high estimate of the total heat transfer. A simple iterative process greatly reduces the error:

i) The number of coolant channels is equal to the width of the heat exchanger (7.6 cm) divided by the distance between channels (b+2a+H). The mean velocity of the coolant, $V_{cool}$, through the channels is given by Equation (10) below:

$$V_{cool} = \frac{D_{h-cool}^2 \Delta P_{cool}}{32\mu_{cool}F_w} \tag{10}$$

ii) Given the total number of coolant channels, the cross section of the coolant channels, and the mean velocity through the coolant channels, the mass flow rate of the coolant through the heat exchanger is easily determined. The exit temperature of the coolant is calculated using Equation (11).

$$q=\dot{m}_{cool}c_{p\text{-}cool}(T_{cool\text{-}inlet}-T_{cool\text{-}exit}) \quad (11)$$

iii) The mean value of the coolant temperature in Equation (11) is the average of $T_{cool\text{-}inlet}$ and $T_{cool\text{-}exit}$. This mean temperature is substituted into Equation (7) as the updated value of $T_{cool}$. Equations (7)–(10) are iterated, and a new value of $T_{cool\text{-}exit}$ is determined. The process is repeated iteratively until successive calculations produce values of $T_{cool\text{-}exit}$ that differ by less than 0.5° K.

Optimization Procedure

To optimize the heat transfer: front area ratio of the prototype, various combinations of b, w, and y were analyzed. The only difference between the optimization procedures for ceramic and aluminum, one the one hand, versus PMMA polymer, on the other hand, was that in the case of the polymer heat exchangers H was taken to be a function of y (Equation 3), while in the case of ceramics and aluminum, no relation between H and y was specified. Thus for ceramic and aluminum heat exchangers, various combinations of b, w, y, and H were analyzed.

The volume of a heat exchanger was calculated as the product of the frontal area of the heat exchanger and the length of the air channels. The mass of a fabricated heat exchanger was estimated in all cases by using the close approximation that the effective volume of heat exchanger material was 50% of the total volume, and then multiplying by the density of the heat exchanger material.

Results of Optimization Procedure

The calculated optimum designs for polymer (PMMA), ceramic, and aluminum heat exchangers are shown in Table 1. As the thermal conductivity increases, the height of the air channels (H) and the heat transfer both increase. The values of the remaining parameters were set by design constraints. For example, the optimal width of the fins (y) was determined by the specified design constraints as 200 μm. However, heat transfer could be enhanced by about 15% by reducing the width between air channels to only 100 μm. While not allowed to vary in this analysis, the distance from the coolant channel to the base of the fins (a) should be minimized to the extent practical, especially in the case of a polymer heat exchanger, to reduce the resistance associated with the low conductivity of most polymers. In making the initial prototype, we elected to sacrifice any added advantage of narrowing the dimensions (a) and (y) below the existing constraints.

TABLE 1

| Material | k (W/m²K) | w (μm) | H (μm) | y (μm) | L (mm) | a (μm) | b (μm) | V (m/sec) | N | q (W) |
|---|---|---|---|---|---|---|---|---|---|---|
| Plastic | 0.20 | 200 | 775 | 200 | 1.8 | 100 | 500 | 7.5 | 9500 | 359 |
| Ceramic | 3.0 | 200 | 1000 | 200 | 1.8 | 100 | 500 | 7.7 | 8000 | 547 |
| Aluminum | 237 | 200 | 1200 | 200 | 1.8 | 100 | 500 | 7.8 | 7300 | 616 |

Performance comparisons between the calculated optimum designs and those of several innovative car radiators are shown in Table 2. Although the micro heat exchangers have somewhat less heat transfer per unit frontal area (q/A), recall that they are much thinner than existing designs. Note that the novel designs exhibit remarkably greater heat transfer per unit volume (q/V) and per unit mass (q/m). In addition to being lighter, the cost of the materials for the novel heat exchanger is lower since less material is used. Although not shown in Table 2, the air velocities and air and coolant flow rates to produce comparable heat transfer for the various designs are comparable to one another.

TABLE 2

| Heat Exchanger | $\Delta P_{air}$ (Pa) | $\Delta P_{cool}$ (kPa) | q/A (W/cm²) | q/V (W/cm³) | q/m (kW/kg) |
|---|---|---|---|---|---|
| Webb - 1 Row | 179 | 1.65 | 23.3 | 1.41 | 3.29 |
| Webb - 2 Row | 204 | 7.45 | 23.3 | 1.26 | 2.93 |
| Parrino | 179 | 2.5 | 23.3 | 1.53 | 2.55 |
| PMMA (new design) | 175 | 5 | 6.2 | 34.4 | 58.9 |
| Ceramic (new design) | 175 | 5 | 9.4 | 52.4 | 41.6 |
| Aluminum (new design) | 175 | 5 | 10.6 | 59.0 | 44.9 |

References to innovative car radiators cited for comparison in Table 2: R. Webb et al., "Improved thermal and mechanical design of copper/brass radiators," SAE Technical Paper Series, No. 900724 (1990); M. Parrino, et al., "A high efficiency mechanically assembled aluminum radiator with real flat tubes," SAE Technical Paper Series, No. 940495 (1994).

Although not shown in Tables 1 and 2, if the novel heat exchanger were fabricated from a highly conductive material (e.g., copper or aluminum), and if the design constraints were relaxed (e.g., allowing the fin width (y) to have a minimum value of 50 mm), it would be possible to make a micro heat exchanger having a greater air channel area: frontal area ratio, and having values of heat transfer: frontal area as high as those for the innovative car radiator designs, and having still greater ratios of heat transfer: mass and heat transfer: volume.

Fabrication of Prototype PMMA Cross Flow Micro Heat Exchanger:

A prototype cross flow micro heat exchanger was manufactured in two halves using the LIGA process. A traditional machining process on the two halves followed. The halves were then aligned and bonded. A leak test confirmed that the coolant channels were well sealed, and would not leak under conditions of use. As of the priority date of this patent application, testing to measure the prototype's actual heat transfer properties and pressure drops is underway.

LIGA Process

The LIGA process (a German acronym for lithography, electroforming, and molding) of manufacturing microstructures is well known. See, e.g., A. Maner et al., "Mass production of microdevices with extreme aspect ratios by electroforming," *Plating and Surface Finishing*, pp. 60–65 (March 1988); W. Bacher, "The LIGA technique and its potential for microsystems—a survey," *IEEE Trans. Indust. Electr.*, vol. 42, pp. 431441 (1995); E. Becker et al., "Production of separation-nozzle systems for uranium enrichment by a combination of x-ray lithography and galvanoplastics," *Naturwissenschaften*, vol. 69, pp. 520–523 (1982).

Figure 4:
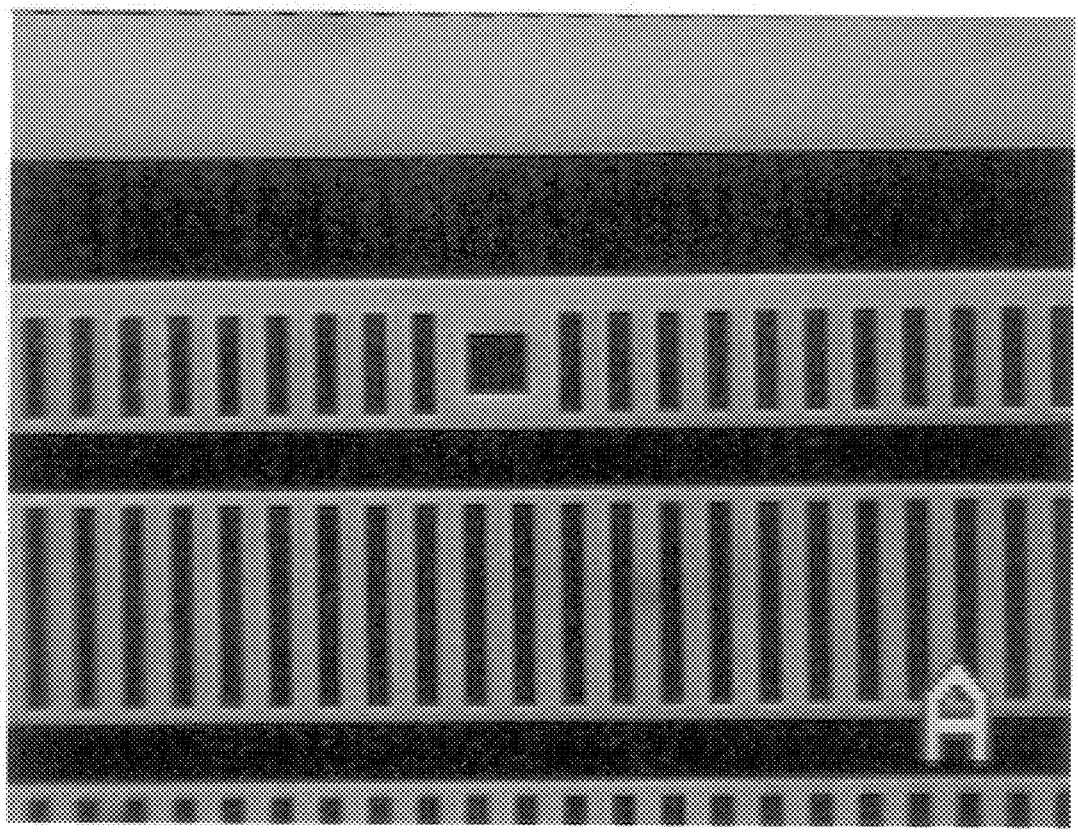
FIGS. 4 and 5 are scanning electron micrographs of a completed prototype x-ray mask.
Figure 5:
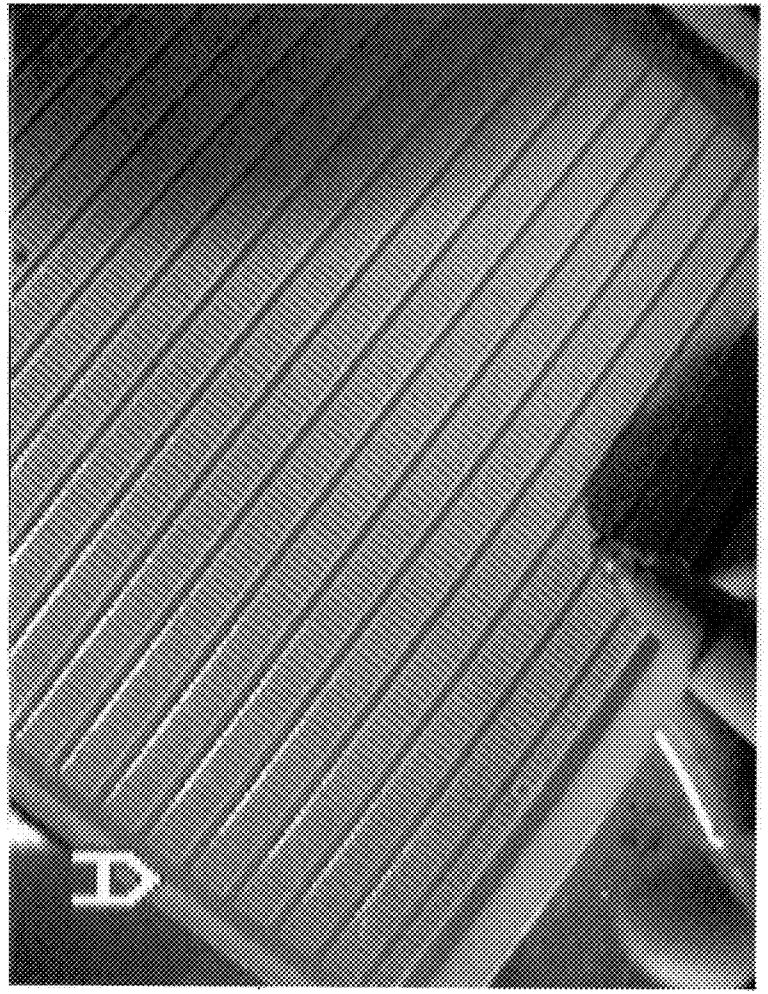

A 2" by 2" prototype cross-flow micro-heat exchanger pattern (rather than 3"×3" as in the analytical model) was created on an optical mask using a pattern generator using standard LIGA techniques. A gold-absorber-on-graphite-membrane X-ray mask was then fabricated from the optical mask using the process described in United States provisional patent application 60/141,365, filed Jun. 28, 1999; see also C. Harris et al., "Inexpensive, quickly producible x-ray mask for LIGA," *Microsystems Technologies*, vol. 5, pp. pages 189–193 (1999). A scanning electron micrograph of the completed x-ray mask is illustrated in FIGS. 4 and 5. (The capital letter "A" appearing in these electron micrographs is an artifact that may be disregarded.) The square shown in FIG. 4 was used to produce alignment holes, as discussed later.

Figure 6:
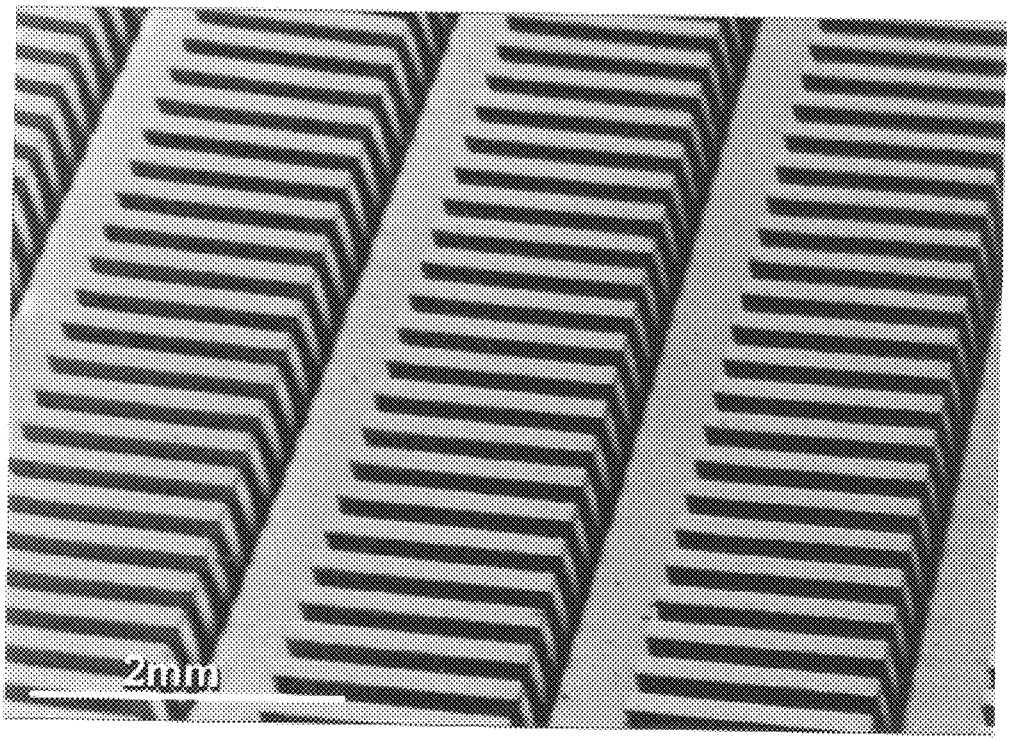
FIGS. 6 and 7 are scanning electron micrographs of a completed prototype mold insert.
Figure 7:
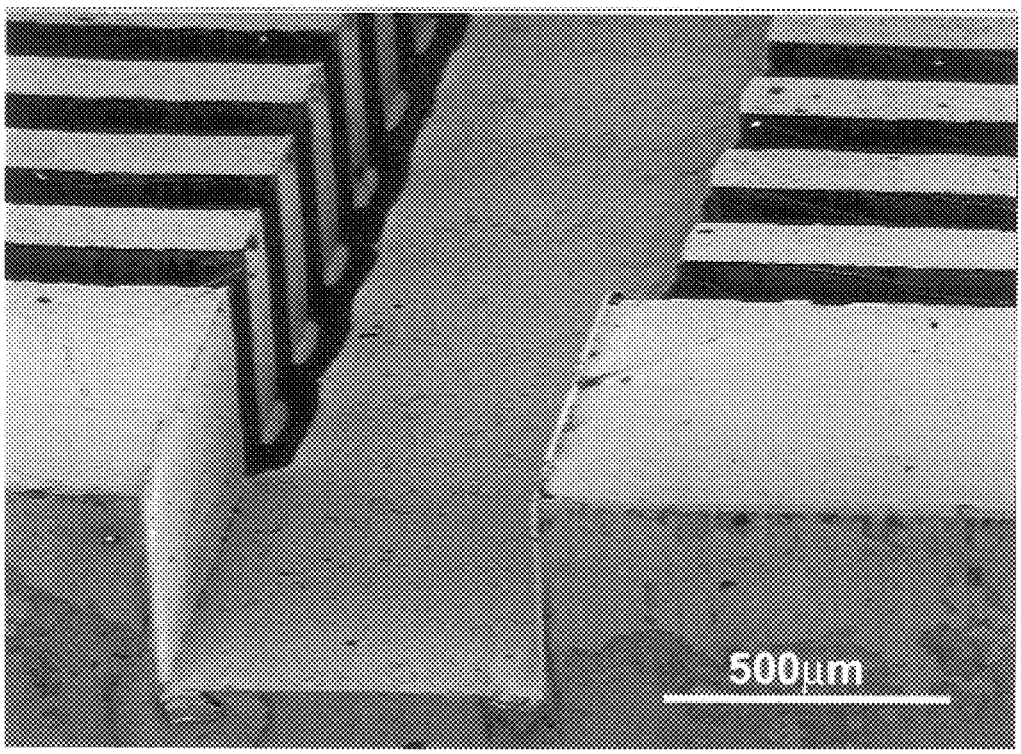

The graphite mask was used for the x-ray exposure of a 1 mm thick sheet of PMMA bonded to a titanium substrate. The PMMA was developed, and nickel structures were electroplated into the voids using a nickel sulfamate bath, both using standard techniques. After the voids were filled, electroplating continued until the overplated area had a thickness of 3 mm. The nickel was then de-bonded from the titanium with minimal force, and the back surface of the mold insert was ground so that the back side was parallel to the patterned side. A final machining operation was needed to complete the insert before the PMMA was dissolved. Since the air channels are through-holes, while the coolant channels must be enclosed on the front and back faces of the heat exchanger, the nickel structures on the mold insert that correspond to the coolant channels were milled down to a depth of 300 $\mu$m. A jeweler's saw on a milling machine and a magnifying glass were used to perform this machining operation. Scanning electron micrographs of the completed mold insert are shown in FIGS. 6 and 7. The milled coolant channel is particularly prominent in FIG. 7.

Figure 8:
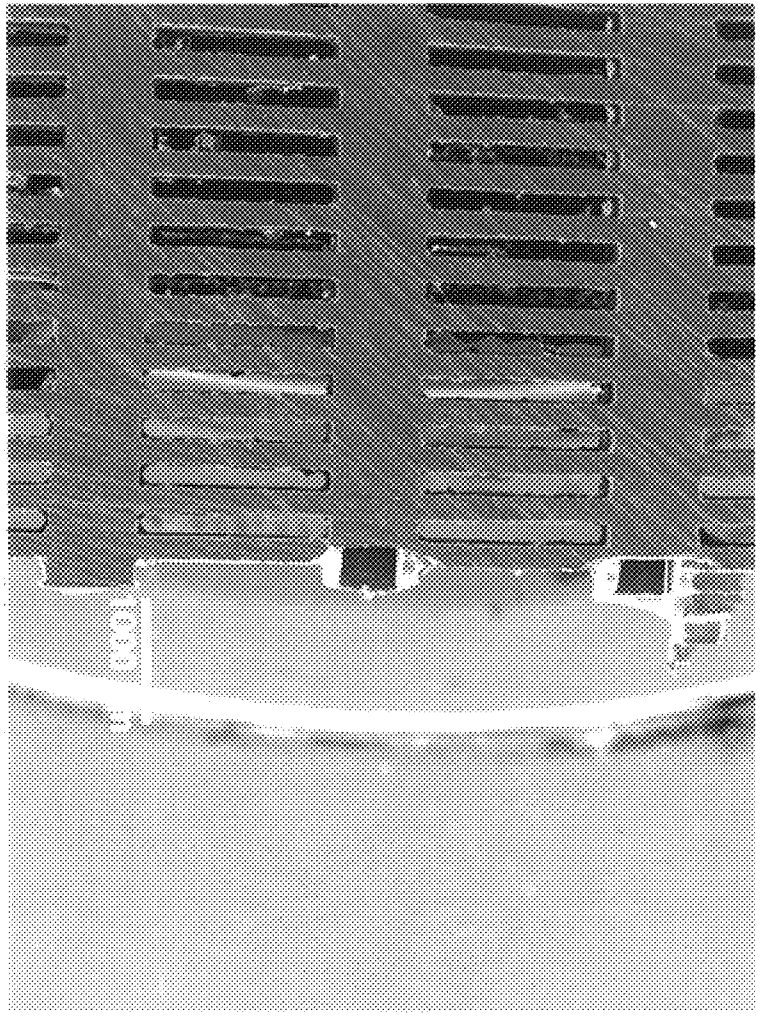
FIG. 8 is a scanning electron micrograph of the top view of an assembled prototype embodiment of the heat exchanger.
Figure 9:
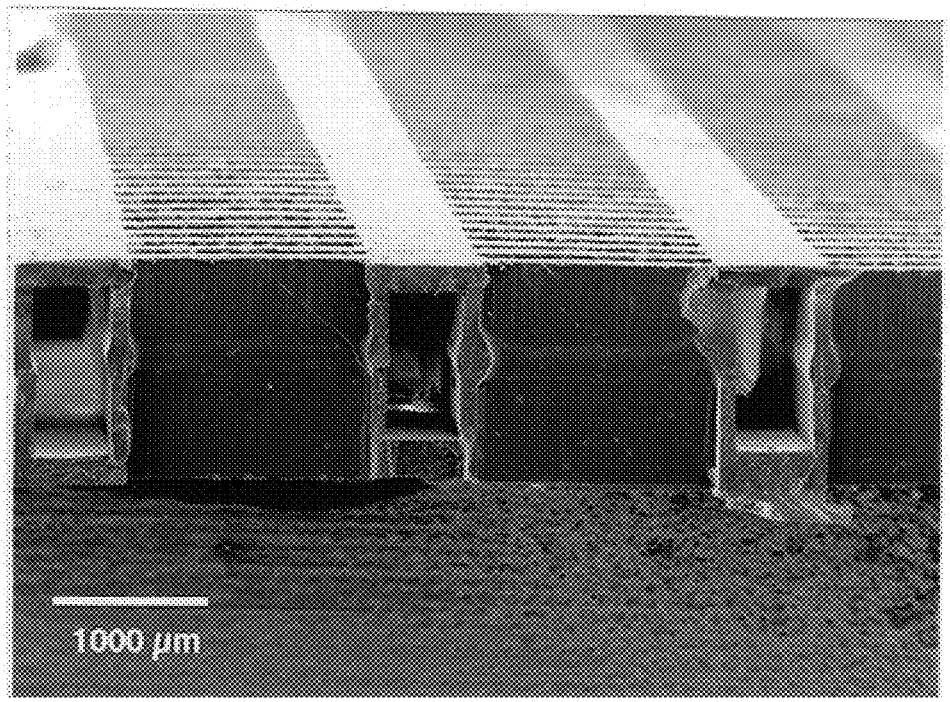
FIG. 9 is a scanning electron micrograph of the side view of an assembled prototype embodiment of the heat exchanger.

Each half of the heat exchanger was then embossed in PMMA using the completed mold insert. (The insert was symmetrical, so that the same insert could be used to mold both halves of the heat exchanger.) A scanning electron micrograph of the top view of the assembled prototype is illustrated in FIG. 8. The back side of the embossed piece was flycut to expose the air channels. The remainder of the PMMA backing was removed by polishing. A scanning electron micrograph of a side view of the assembled prototype embodiment of the PMMA heat exchanger is illustrated in FIG. 9.

Bonding and Alignment

We investigated several adhesive techniques to bond the two halves of the heat exchanger together. We tested a urethane adhesive, a strong spray adhesive, a mist spray adhesive, an ultraviolet glue, a heat sensitive glue, a methyl methacrylate bonding solution, and acetone. Each technique was evaluated for bond strength, uniformity, work-life, ease of use, clogging of the channels, deformation of PMMA, transparency, and high temperature resistance. Using these criteria, the best adhesive for this purpose was clearly the urethane adhesive. In particular, the selected adhesive was the two part Durabond™ 605FL urethane adhesive manufactured by Loctite (Rocky Hill, Conn.), designed for flexible bonds having high peel resistance and high shear strength.

The machined, embossed pieces were prepared for bonding by thoroughly cleaning the surfaces in detergent and water, followed by drying in an 80° C. oven for one hour. Baking in the oven also helped to relieve any internal stress in the PMMA. Urethane adhesive was then mixed according to the manufacturer's instructions (two parts resin, one part hardness), and a thin portion about 2 cm in diameter was applied onto a circular silicon wafer. The wafer was spun at 3000 RPM to achieve a uniform thin coating. One of the halves of the heat exchanger was then pressed briefly onto the urethane-covered silicon wafer, resulting in a uniform, thin adhesive coating on the PMMA. The two halves were then aligned using four 500 $\mu$m-diameter alignment holes, i.e., four holes on each of the halves. (The complement of one of the alignment holes is visible in the mold insert depicted in FIG. 4.) Pencil "lead" segments (i.e., graphite) 0.5 mm in diameter were used as alignment pins. The two halves of the exchanger were lightly pushed together and air was blown through the air channels to clear out any urethane adhesive in the channels. A pneumatic press held the pieces together at 10 psi for 24 hours to allow the adhesive to cure.

Liquid was run through the completed 2"×2" heat exchanger at a flow rate of 20 g/sec. (This flow rate for this size exchanger is proportionately greater than the coolant flow rates reported for current innovative car radiators.) No leakage was observed, verifying that the sealing was complete. As of the priority date of this patent application, preparations to test the prototype's actual heat transfer and pressure drop properties are underway.

Miscellaneous

In future embodiments, the novel heat exchanger will be fabricated from ceramic, aluminum, or copper to improve performance further. Alternatively, polymer-based heat exchangers could be infiltrated with more conductive materials such as ceramic, aluminum, or copper. We have calculated that heat transfer could be improved by about 50% by forming a heat exchanger from aluminum rather than PMMA.

A heat exchanger with more numerous, smaller channels transfers heat much more efficiently per unit volume or per unit mass than will a heat exchanger with larger channels. The LIGA process allows one to mass produce one geometry as inexpensively as the other (within limits), so the costs normally associated with increased complexity are not an issue. A separate design consideration is a trade-off between the stringency of filtering required (especially air filtering) and the heat exchange capacity achievable by reducing the channel size. The smaller the channels are, the more stringently the filtering must be to avoid clogging the channels.

Although the embodiments described above refer primarily to fluid-gas heat exchange, this invention will work generally for fluid-fluid heat exchange. Either of the two fluids may, for example, be a gas, a liquid, a supercritical fluid, or a two-phase fluid such as a condensing vapor.

Miscellaneous

Following are publications of the inventors' own work, none of which is prior art to this application, and copies of each of which are located in the file history of this patent: R. Brown, "LSU gets $1.3M for heat exchange research," *LSU Today*, vol. 16, no. 16, p. 4 (Nov. 12, 1999); K. Kelly, "Heat exchanger design specifications," slides presented at DARPA Principal Investigators Meeting, Atlanta, Ga. (Jan. 13, 2000); K. Kelly, "Applications and Mass Production of High Aspect Ratio Microstructures Progress Report," MEMS Semi-Annual Reports (July 1999).

Symbols Used—Unless otherwise clearly indicated by context, the symbols listed below have the meanings indicated, as used in both the specification and the Claims. In some instances, a symbol defined below may be used with an additional subscript, though the symbol-subscript combination may not be separately defined below. In such cases, the meaning of the symbol with the subscript should be clear from context.

Symbols

H—Height of air channel
w—Width of air channel
y—Width between air channels
L—Depth or length of air channel
a—Thickness of wall that separates the water and air channels
b—Width of water channel
$\Delta p$—Pressure drop of air or coolant
f—Friction factor
$\rho$—Density of fluid
V—Velocity
$D_h$—Hydraulic diameter
K—Loss coefficient for inlet and exit effects
Nu—Nusselt number
Re—Reynolds number
Pr—Prandtl number
h—Convection coefficient
k—Thermal conductivity
$R_1$—Convective resistance at the coolant/wall interface
$R_2$—Conductive resistance of wall separating the coolant and air channels
$R_3$—Effective convective fin resistance
$\eta_f$—Fin efficiency
$R_{tot}$—Total resistance to heat transfer
T—Temperature of air or coolant
$\dot{m}$—Mass flow rate of air through one row of channels
$c_p$—Specific heat
$q_{channel}$—Heat transfer for one air channel
q—Total heat transfer
N—Number of air channels
$\mu$—Viscosity
$F_W$—Total width of heat exchanger
$F_H$—Total height of heat exchanger

We claim:

1. A heat exchanger for transferring heat between a first fluid and a second fluid; wherein said heat exchanger comprises first fluid channels through which the first fluid may flow, and second fluid channels through which the second fluid may flow, wherein said second fluid channels lie generally in a plane; wherein said first fluid channels and said second fluid channels interleave, so that heat may be transferred between said first fluid channels and said second fluid channels; wherein the direction of flow of said first fluid channels is generally perpendicular to the plane of said second fluid channels; and wherein said heat exchanger has a density of said first fluid channels greater than about 50 per square centimeter.

2. A heat exchanger as recited in claim 1, wherein said first fluid channels are adapted for the flow of a gas, and wherein said second fluid channels are adapted for the flow of a liquid.

3. A heat exchanger as recited in claim 1, wherein the thickness of said heat exchanger, in the direction of flow of said first fluid channels, is less than about 2.0 mm.

4. A heat exchanger as recited in claim 1, wherein the thickness of said heat exchanger, in the direction of flow of said first fluid channels, is less than about 1.0 mm.

5. A heat exchanger as recited in claim 1, wherein the width of said second fluid channels, in a direction that is generally perpendicular to the direction of flow of said first fluid channels and is also generally perpendicular to the direction of flow of said second fluid channels,is less than about 500 $\mu$m.

6. A heat exchanger as recited in claim 1, wherein said heat exchanger has a density of said first fluid channels greater than about 200 per square centimeter.

7. A heat exchanger as recited in claim 1, wherein the thickness of said heat exchanger, in the direction of flow of said first fluid channels, is less than about 1.0 mm; wherein the width of said second fluid channels, in a direction that is generally perpendicular to the direction of flow of said first fluid channels and is also generally perpendicular to the direction of flow of said second fluid channels, is less than about 500 $\mu$m; and wherein said heat exchanger has a density of said first fluid channels greater than about 200 per square centimeter.

8. A heat exchanger as recited in claim 1, wherein said heat exchanger is fabricatedfrom a polymer.

9. A heat exchanger as recited in claim 1, wherein said heat exchanger is fabricatedfrom a ceramic.

10. A heat exchanger as recited in claim 1, wherein said heat exchanger is fabricatedfrom copper.

11. A heat exchanger as recited in claim 1, wherein said heat exchanger is fabricatedfrom aluminum.

12. A heat exchanger as recited in claim 1, wherein said heat exchanger is fabricated from metal.

13. A heat exchanger as recited in claim 1, wherein the thickness of said heat exchanger, in the direction of flow of said first fluid channels, is less than about 6.0 mm.

14. A heat exchanger as recited in claim 1, wherein the width of said second fluid channels, in a direction that is generally perpendicular to the direction of flow of said first fluid channels and is also generally perpendicular to the direction of flow of said second fluid channels, is less than about 2.0 mm.

15. A heat exchanger as recited in claim 1, wherein the thickness of said heat exchanger, in the direction of flow of said first fluid channels, is less than about 6.0 mm, and wherein the width of said second fluid channels, in a direction that is generally perpendicular to the direction of flow of said first fluid channels and is also generally perpendicular to the direction of flow of said second fluid channels, is less than about 2.0 mm.

* * * * *